US005772484A

United States Patent [19]

Sikorski

[11] Patent Number: 5,772,484

[45] Date of Patent: Jun. 30, 1998

[54] FLOATATION TOY DEVICE

[76] Inventor: Marek Sikorski, 3400 The Credit Woodlands #7, Mississauga, Ontario, Canada, L5C 3A4

[21] Appl. No.: 785,156

[22] Filed: Jan. 13, 1997

[51] Int. Cl.[6] ..... B63C 9/08

[52] U.S. Cl. ..... 441/81; 472/129; 441/131

[58] Field of Search ..... 472/128, 129; 441/45, 80, 81, 88, 106, 122, 123, 125, 126, 129–134, 136; 446/236, 240

[56] References Cited

U.S. PATENT DOCUMENTS

| | | | |
|---|---|---|---|
| 3,656,749 | 4/1972 | Reyes | 472/128 |
| 4,861,300 | 8/1989 | Casagrange et al. | 441/131 |

*Primary Examiner*—Ed L. Swinehart
*Attorney, Agent, or Firm*—Eugene J. A. Gierczak

[57] ABSTRACT

A floatation toy device includes a cylindrical elongated member, a variable buoyancy collar and an attachment collar. The floatation toy device provides for an improved and variable buoyancy of the floatation toy device by the user.

16 Claims, 9 Drawing Sheets

FLOATATION TOY DEVICE

FIELD OF INVENTION

This invention relates generally to a floatation device, and more particularly to a floatation toy device for floating on a water surface and which can also be used as a support or seat structure in the water.

BACKGROUND ART

Floatation devices and namely water toys are problematic in that the buoyancy component for most toys is fixed or stationary on the floatation device. Users of the floatation devices must try and compensate for the fixed buoyancy of the floatation device.

Prior art floatation devices have been devised to address a range of problems, from life saving devices such as life jackets, to floatation devices that may be used as building materials or as toys. For example, U.S. Pat. No. 3,822,499 issued Jul. 9, 1974, provides for a semi-rigid polymeric building block, that may be suitable for constructing a floatable raft. The building block may also be suitable for use as a toy building block.

U.S. Pat. No. 3,624,959 issued Dec. 7, 1971, provides for a toy trimaran that may be made from plastic foam and can move and float easily in water.

U.S. Pat. No. 5,433,637 issued Jul. 18, 1995, provides for a floatation device in the shape of a throwable airfoil similar to a FRISBEE (R) brand toy. The floatation toy device can be used as a cushion to sit upon in the water. The floatation device comprises of a support structure attached to the floatation structure and can be made of poly vinyl chloride foam.

U.S. Pat. Nos. 4,557,219 and 4,513,014 issued Dec. 10, 1985, and Apr. 23, 1985 respectively, provide for an elastomeric polyurethane toy for an animal that can float in the water.

U.S. Pat. No. 5,426,883 issued Jun. 27, 1995, provides for a new and improved floating casting apparatus that includes a floating toy assembly that is buoyant. The toy assembly may be connected to a fishing line which can be reeled in by a fishing rod.

Thus a floatation device with improved buoyancy and which can vary according to the user is desirable.

SUMMARY OF THE INVENTION

An object of one aspect of the present invention is to provide an improved floatation toy device for floating on a water surface.

In accordance with one aspect of the present invention, there is provided a floatation toy device having a cylindrical elongated member, a variable buoyancy means and a connection means or attachment collar whereby the ends of the cylindrical elongated member attach to the connection means.

In accordance with still another aspect of the invention, there is provided a floatation device wherein the variable buoyancy means fits securely around the cylindrical elongated member. The variable buoyancy means may be moved to different positions along the cylindrical elongated member allowing for the buoyancy of the floatation toy device to change at any given point. The outer diameter of the cylindrical elongated member may be greater than the inner diameter of the attachment collar. Therefore the ends of the cylindrical elongated member fit securely into the ends of the attachment collar, as the ends of the cylindrical elongated member expand to their greater diameter once they are fit into the attachment collar. The floatation toy device may be made from polyethylene foam.

In accordance with another aspect of the invention there is provided a floatation toy device comprising of an elongated member with a first end and a second end, and a buoyancy means. The buoyancy means includes a connecting means to which the ends of elongated member attach to. The connecting means associated with the buoyancy means can fixedly increase the buoyancy of the floatation toy device. The buoyancy means can also include a variable buoyancy means that can vary the buoyancy by being moveable along the elongated member.

BRIEF DESCRIPTION OF DRAWINGS

A detailed description of the preferred embodiment is provided herein below with reference to the following drawings, in which.

Figure 1A:
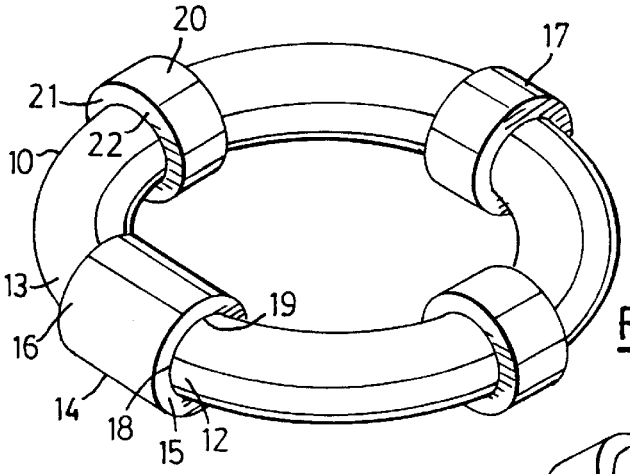
FIG. 1*a*, in a perspective view, illustrates the floatation toy device in accordance with the preferred embodiment of the present invention.
Figure 1B:
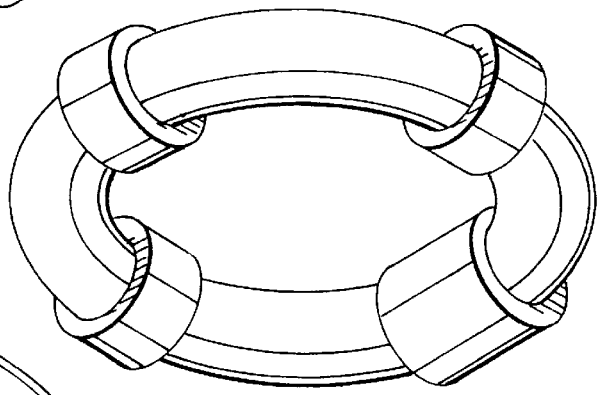
FIG. 1*b*, in a perspective view taken from a point below and from the right side, illustrates the floatation toy device in accordance with FIG. 1*a;*
Figure 1C:
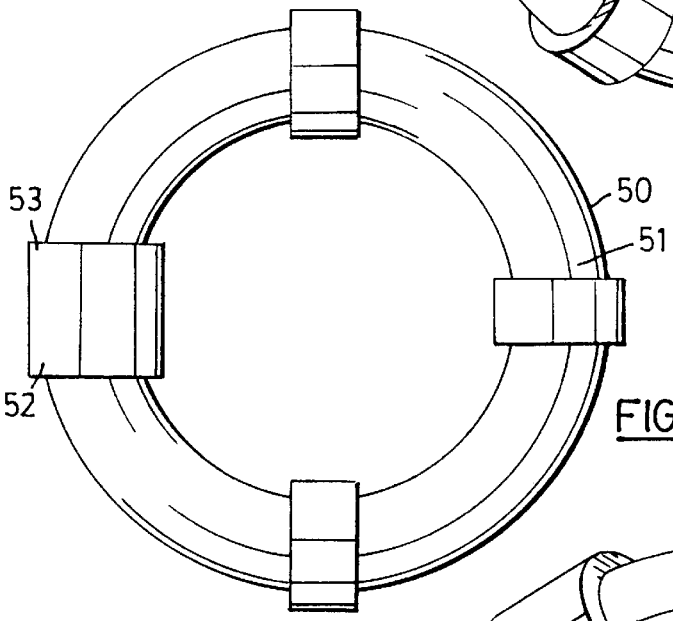
FIG. 1*c*, in a top plan view, illustrates the floatation toy device in accordance with FIG. 1*a;*
Figure 1D:
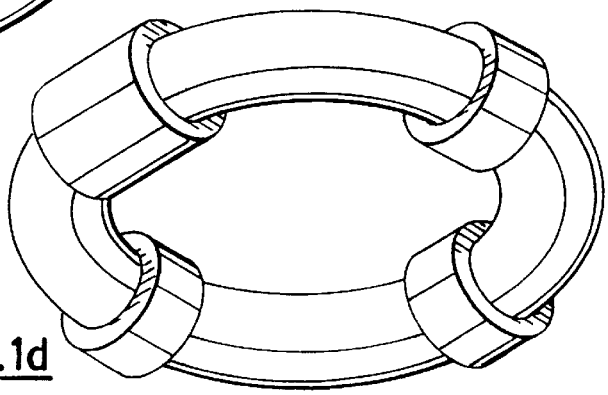
FIG. 1*d*, in a perspective view taken from a point below and from the left side, illustrates the floatation toy device in accordance with FIG. 1*a;*
Figure 2A:
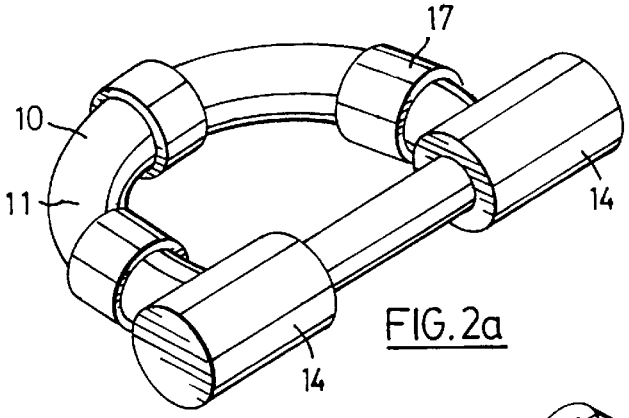
FIG. 2*a*, in a perspective view, illustrates the floatation toy device in accordance with FIG. 1*a* configured in a different shape.
Figure 2B:
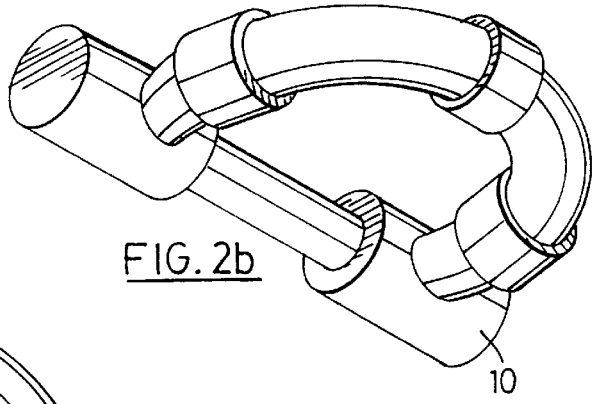
FIGS. 2*b,d,e* and *f*, in perspective views taken from a point either above or below, or from the left or right sides of the floatation toy device, illustrate the floatation toy device in accordance with FIG. 2*a;*
Figure 2C:
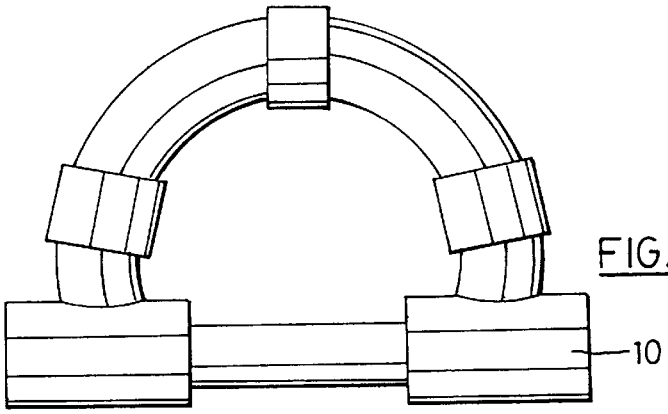
FIG. 2*c*, in a top plan view, illustrates the floatation toy device of FIG. 2*a*.
Figure 2D:
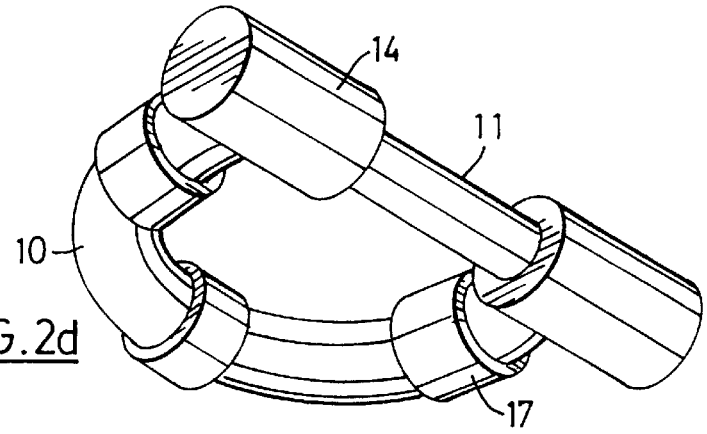
Figure 2E:
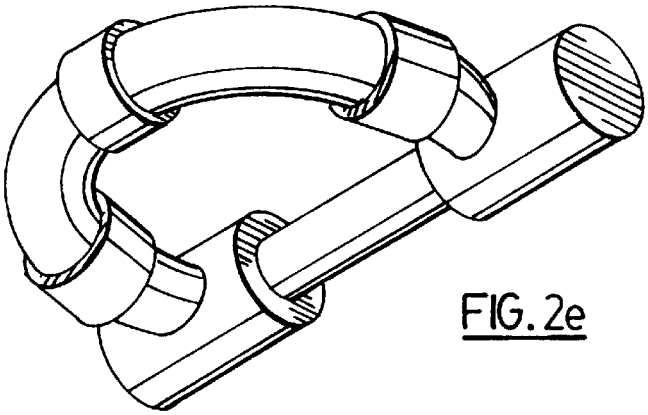
Figure 2F:
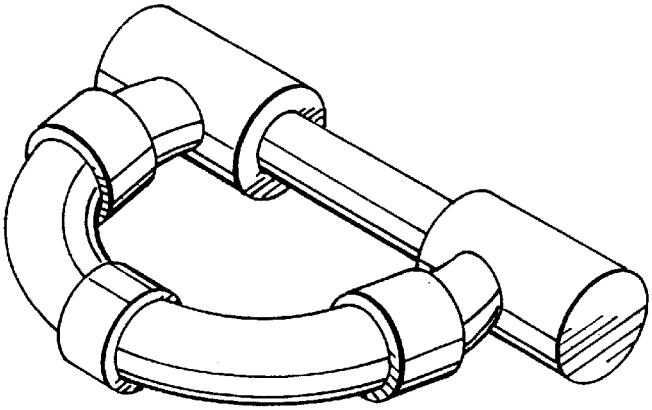

In the drawings, preferred embodiments of the invention are illustrated by way of example. It is to be expressly understood that the description and drawings are only for the purpose of illustration, and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Referring to FIG. 1 there is illustrated in a perspective view, a floatation toy device 10 in accordance with the preferred embodiment of the present invention. The cylindrical elongated member 11 can be made from a variety of materials which are generally buoyant such as polyethylene foam or the like. The floatation toy device 10 also includes additional buoyancy means or structure, namely the connection means or attachment collars 14 which are generally fixed relative the cylindrical elongated member 11 and moveable floatation collar or variable buoyancy means 17. The floatation toy device 10 includes a cylindrical elongated member 11 having a first end 12 and a second end 13, a connection means or attachment collar 14 that has a first end 15 and a second end 16, and a variable buoyancy means 17. The attachment collar 14 has an inner diameter 18 which is less than the outer diameter 19 of either end of the cylindrical elongated member 11. In this way the ends 12 and 13, of the cylindrical elongated member 11, may be friction fit into the inner diameter 18 of the attachment collar 14. A suitable adhesive between the ends 12 and 13 of the cylindrical elongated member 11 and the inner diameter 18 of the attachment collar 14 will ensure that the device is maintained in an assembled fashion. The attachment collar 14 is comprised of a buoyant material such as polyethylene foam and will therefore increase the buoyancy of the floatation toy device 10 in the vicinity of the attachment collar 14.

Figure 7:
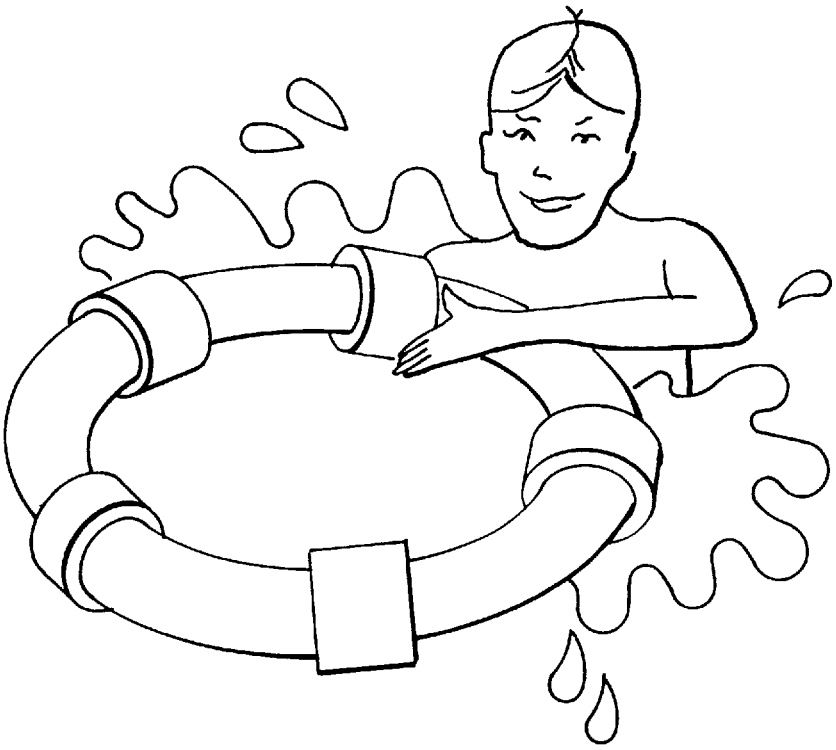
FIG. 7, in a perspective view, illustrates the floatation toy device of FIG. 1 configured in use.

The variable buoyancy means 17 may comprise of a movable floatation collar 20 that may be moved along the cylindrical elongated member 11 to vary the buoyancy of the cylindrical elongated member 11 and therefore the floatation toy device 10. The moveable floatation collars 20 have an inner diameter 21 which will permit the moveable floatation collar 20 to be moved along the outer diameter 22 of cylindrical elongated member 11. For example, the three moveable floatation collars 20 shown in FIG. 1*a*may be moved so as to be disposed at 90° relative each other or they may be moved so as to collect in the vicinity of the attachment collar 14 so as to vary or increase the buoyancy of the floatation toy device 10 in the vicinity of the attachment collar 14. Furthermore by collecting the moveable floatation collars 20 in the vicinity of attachment collar 14, this will increase the diameter size of the cylindrical elongated member 11 and provide an enlarged support surface for the user to surmount when the floatation toy device 10 is in the water. The increased buoyancy in the area will assist the user to float in the water, particularly when part of the floatation toy device sticks outside of the water as shown in FIG. 7. Referring to FIGS. 1*a–d* there is illustrated in a top view, a floatation toy device 50 in accordance with a second preferred embodiment of the present invention. The floatation toy device 50 includes an elongated member 51, and a buoyancy means 52 which includes a connection means 53. The buoyancy means 52 is fixed so that the buoyancy of the floatation toy device 50 is fixedly increased.

Referring to FIGS. 1*a–d*, the floatation toy device 10 may be assembled by placing or sliding a plurality of variable buoyancy means 17 onto the cylindrical elongated member 11. The first end 12 of the cylindrical elongated member 11 is then placed into the first end 15 of the attachment collar 14, and the second end 13 of the cylindrical elongated member 11 is placed into the second end 16 of the attachment collar 14. As the outer diameter 19 of the cylindrical elongated member 11 is greater than the inner diameter 18 of the attachment collar 14, the first end 12 and the second end 13 of the cylindrical elongated member 11 fit securely into to the attachment collar 14.

Figure 3A:
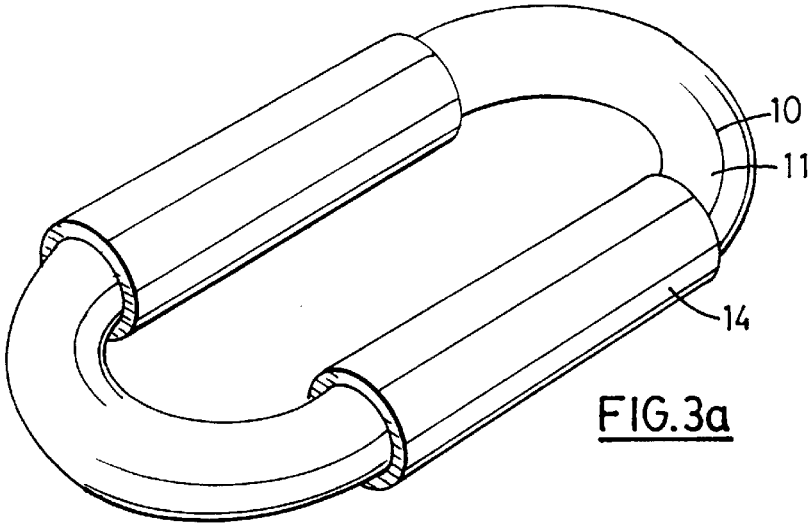
FIG. 3*a*, in a perspective view, illustrates the floatation toy device of FIG. 1*a* configured in a different shape.
Figure 3B:
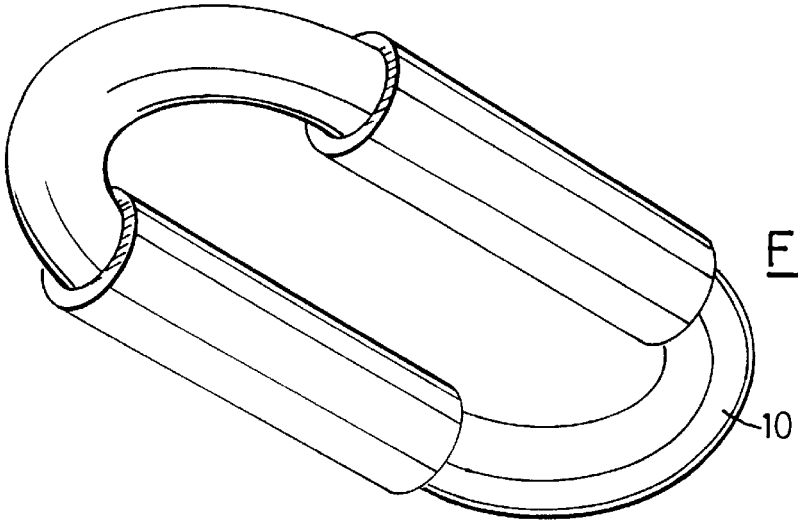
FIG. 3*b*, in a perspective view taken from a point below the floatation toy device, illustrates the floatation toy device of FIG. 3*a*.
Figure 3C:
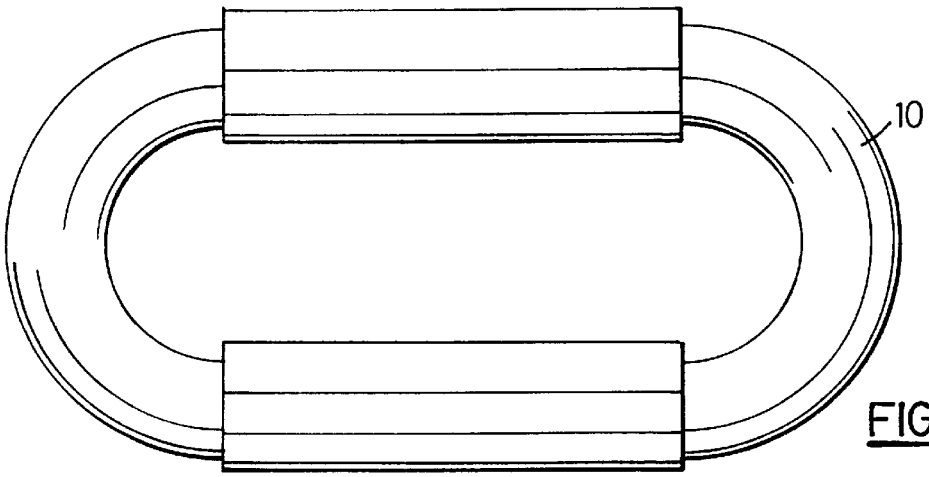
FIG. 3*c*, in a top plan view, illustrates the floatation toy device of FIG. 3*a* configured in a different shape.
Figure 4A:
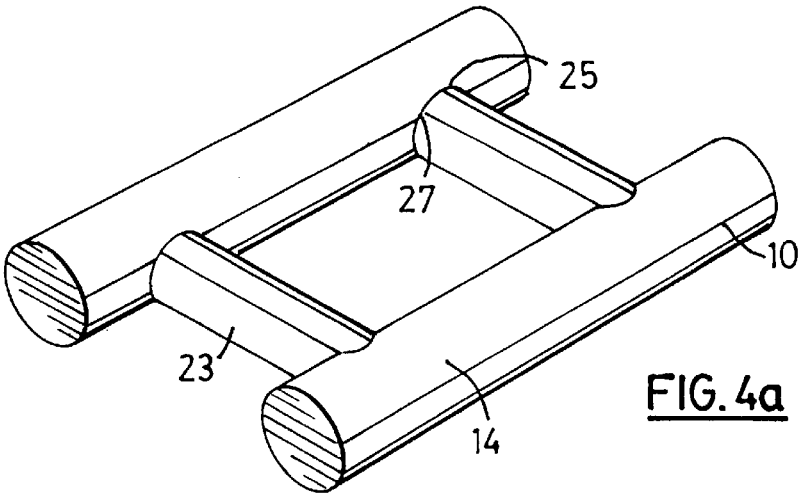
FIG. 4*a*, in a perspective view, illustrates the floatation toy device of FIG. 1*a* configured in a different shape.
Figure 4B:
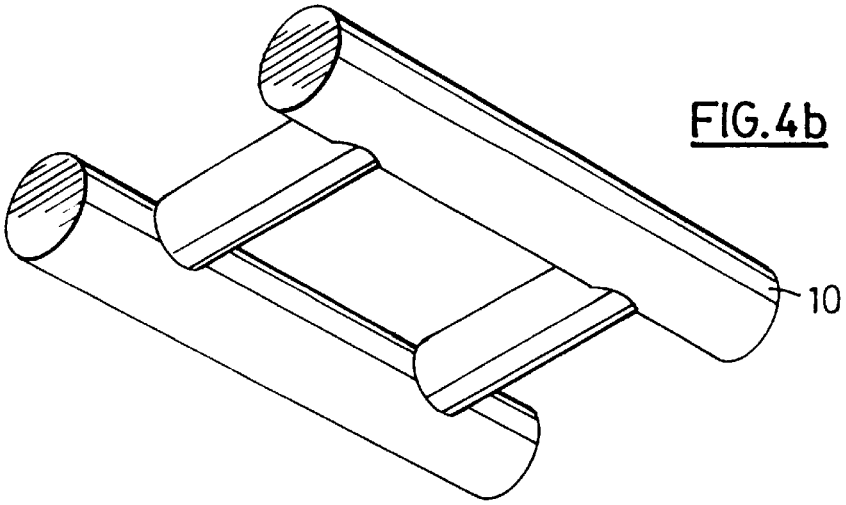
FIG. 4*b*, a perspective view taken from a point below the floatation toy device, illustrates the floatation toy device of FIG. 4*a*.
Figure 4C:
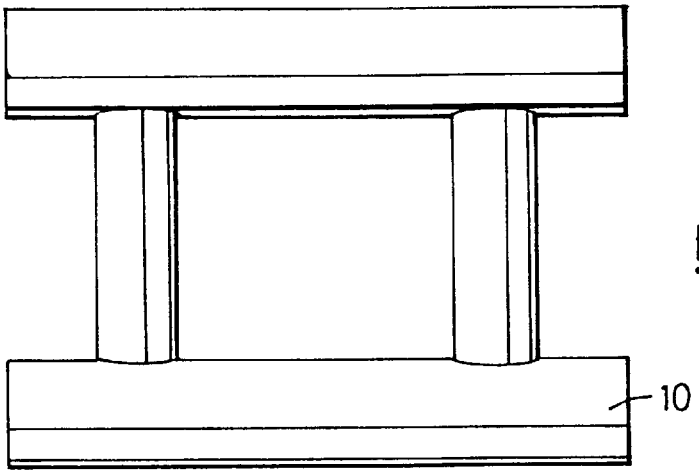
FIG. 4*c*, in a top plan view, illustrates the floatation toy device of FIG. 4*a* configured in a different shape.
Figure 5A:
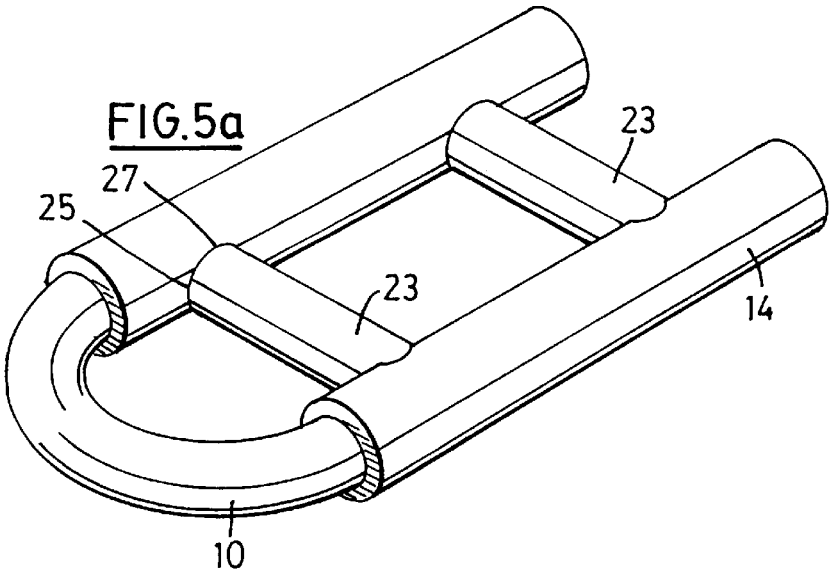
FIG. 5*a*, in a perspective view, illustrates the floatation toy device of FIG. 1*a* configured in a different shape.
Figure 5D:
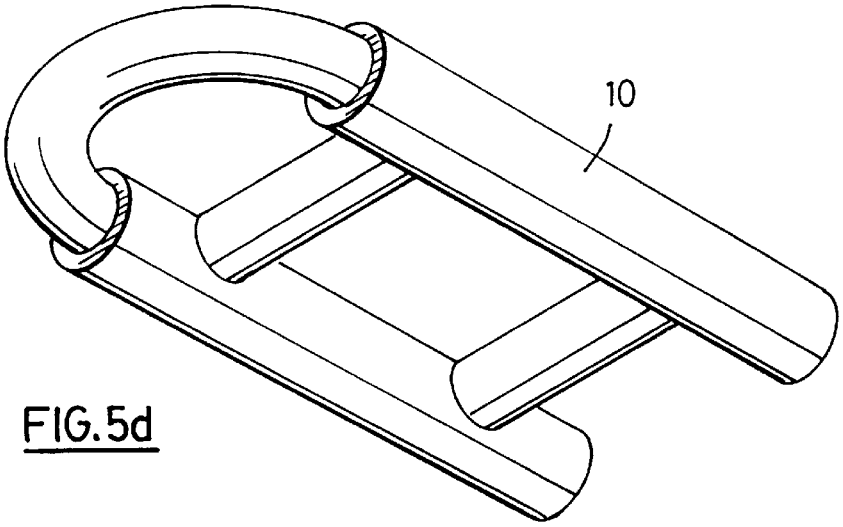
FIGS. 5*b* and *d*, in perspective views taken from a point below, and from either the left or right sides of the floatation toy device, illustrate the floatation toy device in accordance with FIG. 5*a;*
FIG. 5*c*, in a top plan view, illustrates the floatation toy device of FIG. 5*a*.
Figure 5B:
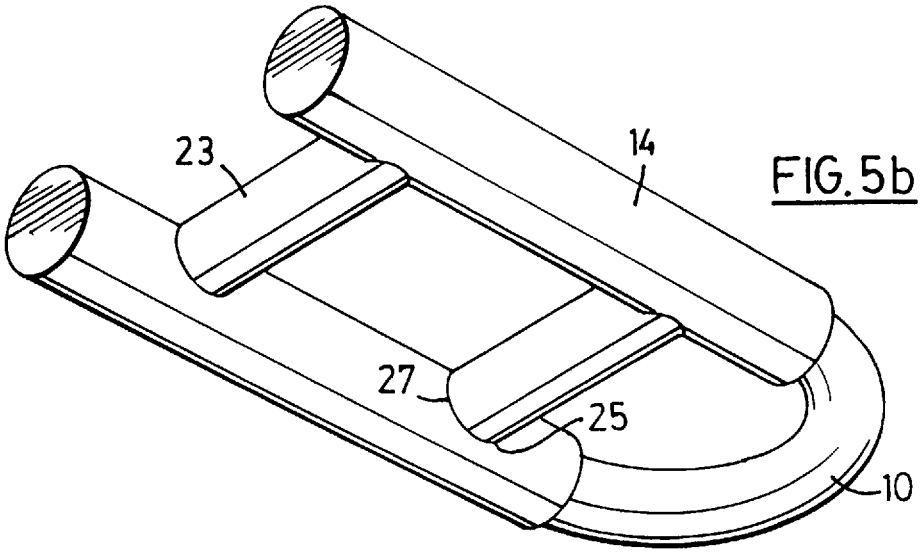
Figure 5C:
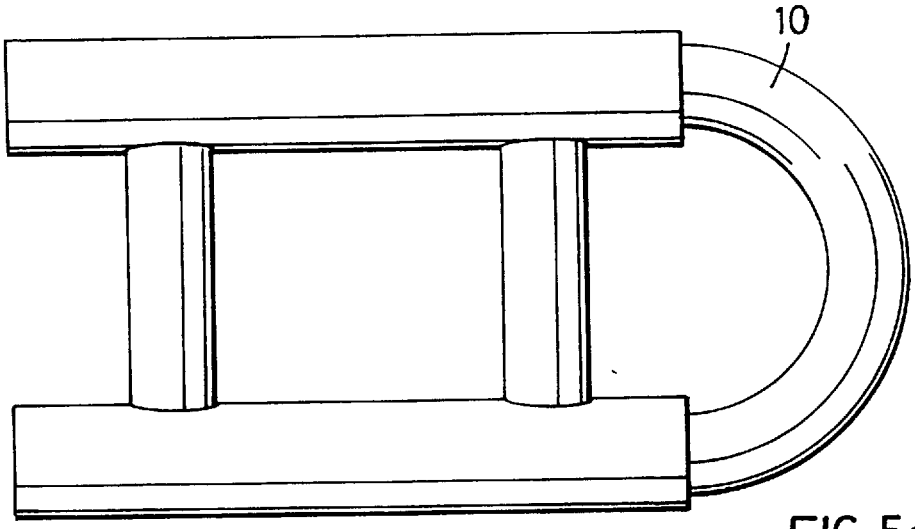
Figure 6A:
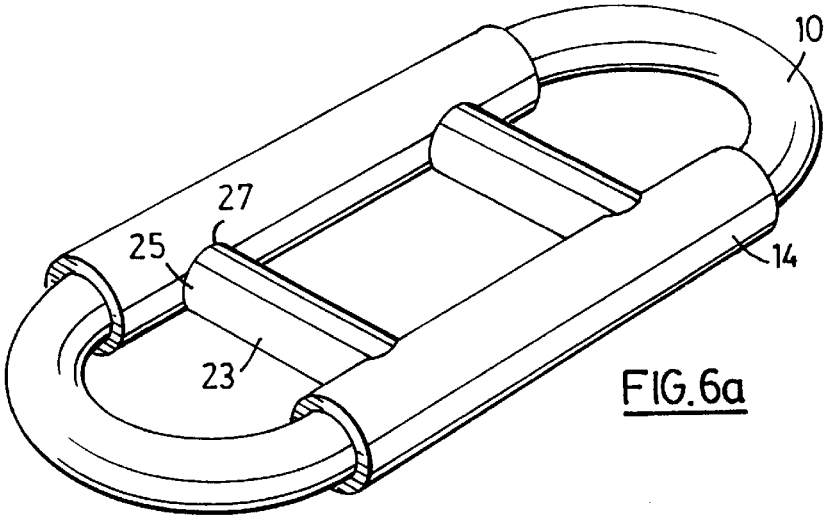
FIG. 6*a*, in a perspective view, illustrates the floatation toy device of FIG. 1 configured in a different shape.
Figure 6B:
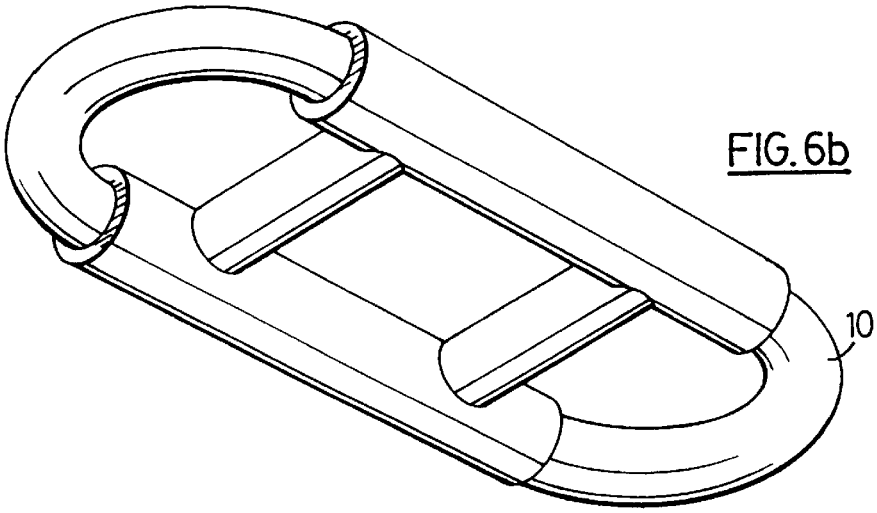
FIG. 6*b*, in a perspective view taken from a point below the floatation toy device, illustrates the floatation toy device of FIG. 6*a*.
Figure 6C:
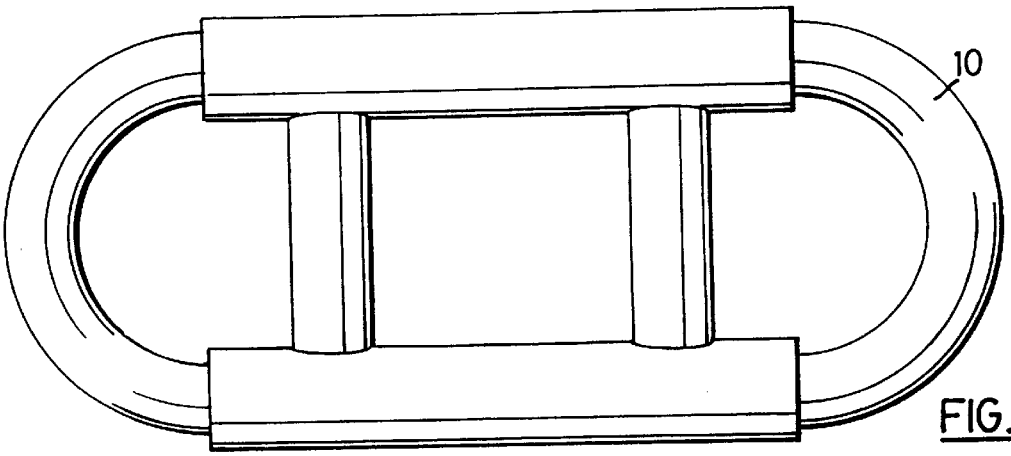
FIG. 6*c*, in a top plan view, illustrates the floatation toy device of FIG. 6*a* configured in a different shape.

Referring to FIGS. 2*a–f*, there is illustrated in a perspective view, the floatation toy device 10 oriented into a D-shape. Referring to FIG. 3*a–c*, there is illustrated in a perspective view, the floatation toy device 10 oriented into an oval shape. Referring to FIGS. 4–6, there is illustrated in three different embodiments, the floatation toy device 10. Referring to FIG. 4*a–c* there is illustrated the floatation toy device 10 oriented in a H-shaped and includes an attachment collar 14 with fixed cross braces 23. The cross braces 23 are comprised of polyethylene foam, having ends 25 that are inserted into an inner diameter 27 presented by attachment collar 14. Accordingly the attachment collar 14, braces 23 of FIGS. 4, 5, and 6 increase the size of the device and hence its buoyancy. Furthermore the attachment collar 14 and cross braces 23 provide a solid wide surface for a user to surround in water. Referring to FIG. 5*a*–5*d*, there is illustrated in a perspective view, the floatation toy device having two parallel sides with a single closed curved end. Referring to FIG. 6*a*–6*c*, there is illustrated in a perspective view, the floatation toy device having two parallel sides with dual closed curved ends.

The attachment of the cylindrical elongated member 11 ends 12 and 13, to the attachment collar 14, is facilitated by the application of an adhesive, such as hot melt pressure sensitive glue, to the outer diameter 19 of the cylindrical elongated member 11 and the inner diameter 18 of the attachment collar 14. The floatation toy device 10 may be constructed from a soft resilient material such as polyethylene foam.

Various embodiments of the invention have now been described in detail. Since changes in and/or additions to the above-described best mode may be made without departing from the nature, spirit or scope of the invention, the invention is not to be limited to said details.

I claim:

1. A floatation toy device comprising: a solid cylindrical elongated member having a first end and a second end, a variable buoyancy means, and a buoyant connection means wherein said first end of said solid cylindrical elongated member and said second end of said solid cylindrical elongated member are frictionally fit to said buoyant connection means.

2. A floatation toy device as claimed in claim 1 wherein said buoyant connection means is an attachment collar having a first end, a second end and an inner diameter.

3. A floatation toy device comprising: a cylindrical elongated member having a first end and a second end, a variable buoyancy means, and an attachment collar having a first end, a second end and an inner diameter wherein said first end of said cylindrical elongated member and said second end of said cylindrical elongated member attach to said inner diameter of said first end of said collar and said inner diameter of said second end of said collar respectively wherein said cylindrical elongated member has an outer diameter greater than said inner diameter of said attachment collar.

4. A floatation toy device as claimed in claim 3 wherein said first end of said cylindrical elongated member friction fits securely into said first end of said attachment collar and said second end of said cylindrical elongated member friction fits securely into said second end of said attachment collars and said outer diameter of said cylindrical elongated member is greater than said inner diameter of said attachment collar.

5. A floatation toy device as claimed in claim 4 wherein said variable buoyancy means comprises a movable floatation collar.

6. A floatation toy device as claimed in claim 5 wherein said movable floatation collar fits securely around said cylindrical elongated member, said movable floatation collar being moveable along said cylindrical elongated member so as to vary the buoyancy of said floatation device along said cylindrical elongated member.

7. A floatation toy device as claimed in claim 1 wherein said solid cylindrical elongated member, buoyant connection means and variable buoyancy means comprises soft resilient buoyant material.

8. A floatation toy device as claimed in claim 7 wherein said soft, resilient material is polyethylene foam.

9. A floatation toy device for floating on a water surface, comprising: a solid cylindrical elongated member, a movable floatation collar, a buoyant attachment collar, said attachment collar having a first and second end and a diameter, said movable floatation collar fitting securely around said solid cylindrical elongated member and being moveable from point to point, said solid cylindrical elongated member having a first and second end whereby said first and second end of said solid cylindrical elongated member friction fit securely into said first and second end of said buoyant attachment collar respectively.

10. A floatation toy device for floating on a water surface, comprising: a cylindrical elongated member, a movable flotation collar, an attachment collar, said attachment collar having a first and second end and a diameter, said movable floatation collar fitting securely around said cylindrical elongated member and being movable from point to point, said cylindrical elongated member having a first end and a second end whereby said first end and second end of said cylindrical elongated member fits securely into said first and second end of said attachment collar respectively, and wherein said first and said second ends of said cylindrical elongated member have a diameter greater than said diameter of said attachment collar.

11. A flotation toy device as claimed in claim 10 wherein said floatation toy device is soft resilient material.

12. A floatation toy device as claimed in claim 11 wherein said soft resilient material is polyethylene foam.

13. A floatation toy device comprising a solid cylindrical elongated member having a first end and a second end and a buoyancy means associated at a fixed point with said solid cylindrical elongated member for changing the buoyancy along said elongated member at said fixed point; wherein said buoyancy means includes (a) a buoyant connection means wherein said first end of said solid cylindrical elongated member and said second end of said solid cylindrical elongated member friction fit to said buoyant connection means, said buoyant connection means increasing the buoyancy along said elongated member at said fixed point.

14. A floatation toy device as claimed in claim 13 wherein said buoyant connection means fixedly increases the buoyancy along said elongated member at said fixed point.

15. A floatation toy device as claimed in claim 13 wherein said buoyancy means further includes a variable buoyancy means for varying the buoyancy at different fixed points along said elongated member.

16. A floatation toy device as claimed in claim 15 wherein said variable buoyancy means comprises a collar moveable along said elongated member so as to vary the buoyancy at different points along said elongated member.

* * * * *

UNITED STATES PATENT AND TRADEMARK OFFICE

CERTIFICATE OF CORRECTION

PATENT NO. : 5,772,484

DATED : June 30, 1998

INVENTOR(S) : Marek Sikorski

It is certified that error appears in the above-identified patent and that said Letters Patent is hereby corrected as shown below:

On the title page, insert the following:

Assignee: Industrial Thermo Polymers Limited
153 Van Kirk Drive
Brampton, Ontario
L7A 1A4
CANADA Recorded: April 1, 1997
Reel/Frame: 8425/0234

Signed and Sealed this

Third Day of August, 1999

*Attest:*

*Attesting Officer*

Q. TODD DICKINSON

*Acting Commissioner of Patents and Trademarks*